US005909856A

United States Patent [19]

Myer et al.

[11] Patent Number: 5,909,856

[45] Date of Patent: Jun. 8, 1999

[54] DUPLEX SLITTER/REWINDER WITH AUTOMATIC SPLICING AND SURFACE/CENTER WINDING

[76] Inventors: William R. Myer, 79 Perryville Rd., Pittstown, N.J. 08867; Alfonse V. Novelli, 5 Appletree Dr., Annandale, N.J. 08801; Henk A. Van Rietschoten, 228 N. Pond View Blvd., Cranbury, N.J. 08512; Mark Van Denend, 349 E. 36th St., Paterson, N.J. 07504

[21] Appl. No.: 08/811,689

[22] Filed: Mar. 5, 1997

[51] Int. Cl.[6] ..... B65H 18/08

[52] U.S. Cl. ..... 242/530; 242/533.6

[58] Field of Search ..... 242/532.3, 527.2, 242/530, 533.4, 533.5, 533.6, 533.2

[56] References Cited

U.S. PATENT DOCUMENTS

| | | | |
|---|---|---|---|
| 1,506,327 | 8/1924 | Perrault . | |
| 2,512,900 | 6/1950 | Kwitek . | |
| 3,157,371 | 11/1964 | Billingsley . | |
| 3,338,530 | 8/1967 | Riegger . | |
| 3,345,009 | 10/1967 | Rockstrom | 242/533.6 X |
| 3,350,027 | 10/1967 | Egan . | |
| 3,383,062 | 5/1968 | Meihofer et al. . | |
| 3,784,122 | 1/1974 | Kataoka . | |
| 4,030,681 | 6/1977 | Schott, Jr. | 242/533.4 X |
| 4,033,521 | 7/1977 | Dee . | |
| 4,398,678 | 8/1983 | Kron et al. . | |
| 4,422,586 | 12/1983 | Tetro . | |
| 4,488,687 | 12/1984 | Andreasson et al. | 242/532.3 X |
| 4,529,141 | 7/1985 | McClenathan . | |
| 4,541,583 | 9/1985 | Forman et al. . | |
| 4,611,769 | 9/1986 | Orbach . | |
| 4,697,755 | 10/1987 | Kataoka . | |
| 4,728,050 | 3/1988 | Luttge et al. | 242/533.4 X |
| 4,846,416 | 7/1989 | Natale . | |
| 5,251,836 | 10/1993 | Pack | 242/533.6 X |
| 5,520,352 | 5/1996 | Prix et al. | 242/533.4 X |

FOREIGN PATENT DOCUMENTS

| | | | |
|---|---|---|---|
| 202801 | 12/1954 | Australia | 242/533.4 |
| 238030 | 10/1959 | Australia | 242/533.4 |

*Primary Examiner*—Donald P. Walsh
*Assistant Examiner*—William A. Rivera
*Attorney, Agent, or Firm*—Lerner, David, Littenberg, Krumholz & Mentlik

[57] ABSTRACT

A high speed winding apparatus for winding a continuous web of material onto cylindrical cores to form winding rolls has at least one turret rotatably mounted to a frame. The web is surface wound at a predetermined surface speed on individual winding arms mounted within the turret. The winding rolls are driven through the cores and are urged against a surface winding drum turning at the web surface speed. Cores are changed automatically by cutting and splicing the web segments to a new set of cores. The completed roll is unloaded, and the turret is then rotated 180° with the empty winding arms passing between the web segments.

14 Claims, 10 Drawing Sheets

DUPLEX SLITTER/REWINDER WITH AUTOMATIC SPLICING AND SURFACE/CENTER WINDING

BACKGROUND OF THE INVENTION

The present invention relates generally to the art of processing web-like material, and more specifically to a method and apparatus for automatically changing a plurality of cores while winding a series of web segments onto the cores.

Web processing lines, whether for forming, printing, laminating or otherwise processing the web, frequently have as a final station a winding machine for winding the web onto one or more cylindrical cores. As each core fills with material and becomes a large roll, the winding operation must be terminated on that core and started on a new core. The core changing operation is often done automatically, without slowing down or stopping travel of the web through the line. Such "on the fly" changeover offers several advantages: first, downtime during the core changeover is avoided, increasing the overall efficiency of the web processing line; second, and often more important, other operations on the line upstream from the winder need not be shut down during core change. This is especially important in certain web forming operations such as the manufacture of a blown film web, where process parameters must be carefully adjusted during start-up, and an interruption in the process requires a long, involved procedure in order to resume the formation of the web.

In addition to winding the web on a roll, it is often desirable to slit the web longitudinally, and to wind the resulting web segments on shorter, individual cores. Machines performing this function are called slitter/rewinders. Such an operation is often performed off-line by a machine that unwinds a web from a "master" or "jumbo" roll produced on a web forming line, slits the web into a series of segments and rewinds the segments onto smaller cores. The operation is performed off-line because slitter/rewinders often require the web to be stopped or slowed down during core changing.

As a web of material is wound on a roll (hereinafter called a "winding roll"), there is a tendency for air to become entrapped between the web and the roll as the web wraps onto the roll. To overcome this problem, lay-on rolls are often used in winding operations. Lay-on rolls are free-wheeling rolls that apply pressure to the outermost layer immediately after it is wound onto the rolls. They are used to prevent air from being pulled into the rolls between adjacent layers. In such an arrangement, the torque required to maintain tension on the web as it is wound onto the roll is provided by driving the core at the center of the roll, a technique called "center winding." Because the diameter of the roll changes as the process progresses, the torque and speed at which the core is driven must change as the roll increases in diameter in order to maintain constant web tension. Even with such controls, however, such an operation may result in "cinching" of the roll and an unevenness in the tightness of the roll between the inner layers and the outer layers.

Lay-on rolls may be adapted to maintain continuous contact with a winding roll during an automatic core changeover. For example, U.S. Pat. No. 4,529,141 discloses a rewinding machine having a turret on which winding cores are supported at diametrically opposite positions. During winding of a web onto a core, a primary frame-mounted lay-on roll applies pressure to the outside of the winding roll, reducing the amount of air entrapped between the layers. Before changing cores, an auxiliary lay-on roll, which is mounted on the turret, is indexed into contact with the web in order to continue to provide pressure on the outside surface of the web during the indexing of the turret. The primary lay-on roll is then retracted, the turret is rotated 180° and the web is severed and attached to an empty core in the opposite position on the turret. Lay-on rolls such as those disclosed in the '141 patent are not driven, and therefore play no part in maintaining tension on the web, which is done by driving the winding roll itself. Because changeover is automatic between cores, this machine may be used at the end of a line without the necessity of stopping or slowing down the line in order to change cores. The machine, however, is not capable of slitting the web into separate segments, and this operation, if required, must be done later off line. Furthermore, because the winding rolls are driven from the core, cinching and uneven tension in the winding roll may be a problem.

A "surface winding drum" is used in order to reduce the cinching and unevenness problems associated with driving the winding operation from the center of the winding roll. A surface winding drum is driven at the surface speed of the incoming web, and is urged against the winding roll at a predetermined pressure at the point where the web joins the winding roll. The web typically travels some angular distance around the winding drum before being transferred to the winding roll at the nip between the two. By driving the surface winding drum at the web surface speed, the surface speed of the outer layer of the winding roll is controlled without transferring torque through the layers of the winding roll. The winding roll may also be driven from the core at a controlled torque in order to prevent loosening of the inner wraps and unevenness that might otherwise result from friction of the core chuck bearings and the angular momentum of the roll during the gradual deceleration of angular velocity during winding.

An example of a surface winding drum is disclosed in U.S. Pat. No. 3,157,371. A single surface winding drum is used in conjunction with two winding rolls contacting diametrically opposite points on the winding drum. The winding rolls are mounted on respective turrets that urge the winding rolls against the winding drum. The incoming web of material is slit by a knife, and the resulting two segments are wound onto the two rolls. In order to change a core, auxiliary lay-on rolls mounted on the turrets are indexed into contact with the completed winding rolls, and the turrets are rotated, indexing new cores into position proximate the winding drum. The web is then severed and attached to the new cores. During rotation of the turrets, the winding drum is not in contact with the active winding rolls. During that time, the winding rolls are instead driven from their centers. Thus, cinching or uneven winding may occur during core changing as torque is transmitted through the roll.

Another winding drum arrangement having automatic core changing is disclosed in U.S. Pat. No. 4,541,583. In this arrangement, primary and secondary surface winding drums are mounted on arms rotatably mounted to the frame, and cores and winding rolls are mounted on a turret. In order to change cores, the secondary winding drum is brought into contact with an empty core, trapping the web between, and a knife and brush assembly is simultaneously indexed across the web, cutting it and attaching it to the core. The newly active core is then indexed to the primary winding position on the turret, and the primary surface winding drum is brought into contact with the active winding roll before contact is broken with the secondary winding drum. Thus, contact is maintained between a winding drum and the winding roll at all times during winding. Such a design does not lend itself to slitting because there is no provision for applying uniform winding pressures for individual rolls created by individual segments of the slit web. Such provisions are necessary, for example, if the unslit web has micrometer thickness variations across its width. In the above-described machine, a single winding roll to winding drum distance is maintained across the width of the web, regardless of thickness variations. Thus, the winding machine disclosed in the '583 patent is not easily adaptable for slitting. If slitting is required for a web processed on such a machine, it must be done by a slitter/rewinder in a subsequent off-line operation.

When a web is slit into individual segments, the center-to-center distance between the winding rolls and the surface winding drum must be adjusted individually for the individual winding rolls. As noted, the winding pressure would otherwise vary on individual winding rolls depending on the web thickness for that individual roll. One way of providing individual winding pressure for each web segment is mounting the individual winding rolls on winding arms. Such a system is disclosed in U.S. Pat. No. 4,697,755. The winding arms permit a force-based adjustment of the relative positions of the winding roll and the surface winding drum for each individual winding roll, while using a single, continuous surface winding drum to wind a plurality of winding rolls. Furthermore, the winding arms may be adjusted during a changeover to accommodate varying segment widths in a slitting/rewinding operation. Each of two surface winding drums in the '755 patent is associated with a series of winding arms, pairs of which support winding rolls receiving alternating web segments. Thus, adjacent web segments are routed to different surface winding drums, providing clearance between the segments for chucks and for the winding arms. No provision is provided for automatic core changing in the slitter/rewinder disclosed in the '755 patent. Instead, the winding operation must be stopped and the arms moved to a load/unload position remote from the surface winding drums, where completed winding rolls are removed and replaced with empty cores.

There therefore remains a need for a machine capable of slitting a relatively wide web into a plurality of segments and winding the segments onto separate cores, wherein the segments are wound relatively evenly throughout the roll, are wound without applying undue torque through the layers of the web, and are wound with substantially the same winding pressure applied to each of the rolls; while at the same time, providing for automatic changeover of the cores without stopping the incoming web. Currently, where a web is formed in a process that cannot be stopped or slowed down, the web is either wound as a single, wide roll that is later slit and rewound, or the web is slit and wound on center winding machines not capable of eliminating the adverse effects caused by applying torque to the winding roll through the core.

SUMMARY OF THE INVENTION

The present invention addresses these needs.

One aspect of the present invention provides a high speed winding apparatus for winding a continuous web of material onto cylindrical cores, and for automatically changing the cores without interrupting the winding. The winding apparatus incorporates a frame, a turret means rotatably mounted in the frame for rotation about a turret axis, a winding drum means rotatably mounted in the turret, and first and second winding roll support arm means. The proximal ends of the first and second support arm means are rotatably mounted at diametrically opposing locations on the turret, offset from the turret axis. The support arm means support first and second winding rolls on distal ends of the arms. The arms are indexable between a winding position, wherein the winding rolls are in rolling contact with the winding drum means, and a loading/unloading position remote from the winding drum means. The turret may be rotated to exchange the locations of the first and second winding roll support arms. The winding roll support arms individually support the winding rolls for urging against the winding drum, and provide even winding of each roll, even when the thickness of the web varies between adjacent individual rolls. The indexable turret permits automatic core changing without stopping the incoming web.

The winding drum means may comprise first and second winding drums for contacting corresponding sets of winding rolls. The first and second winding drums are mounted for rotation in opposing locations on the turret, offset from the turret axis. Alternatively, winding drum means may comprise a single winding drum mounted for rotation at the center of the turret. In this case, both winding rolls in a turret contact the same winding drum.

The turret means is indexable to move the first and second winding roll support arms between a loading position and an unloading position. The web enters the turret between the loading and unloading positions. In this aspect of the invention, the winding apparatus further comprises a core chucking means on the distal ends of the support arms that is retractable so that the arms clear the web during indexing of the turret.

In another aspect of the invention, the winding roll support arm means are driving means for driving new cores at a surface speed corresponding to the surface speed of the web, and for maintaining a predetermined amount of torque through the winding roll. Each support arm means may comprise first and second arms for supporting first and second ends of the core. The support arm means may alternatively comprise a cantilevered single arm for supporting the core.

Another aspect of the invention relates to first and second cut-off means mounted in the turret. The cut-off means are mounted in proximity with corresponding first and second support arm means, for cutting the web during automatic changing of the web cores. The cut-off means may comprise a knife for cutting the web, a brush for urging the cut web against an empty core in the winding position for initiating the winding of a new winding roll, and an actuation means for moving the knife through the web and moving the brush past the empty core. The winding arms may be indexable to a pre-splice position whereby the empty core is proximate to but not in contact with the winding drum.

In another aspect of the invention, a high speed slitter/rewinder apparatus for slitting a web of material into a plurality of web segments includes means for winding the plurality of segments onto a plurality of cylindrical cores. The slitter/rewinder apparatus comprises a frame, a slitter means mounted to the frame for longitudinally slitting the web of material into the plurality of segments, and at least one turret rotatably mounted in the frame for rotation about a turret axis. A winding drum means is rotatably mounted in each turret. First and second support assembly means are also mounted in each turret at opposing locations on the turret, offset from the turret axis, for removably and rotatably mounting the plurality of web cores, for individually driving rotation of the web cores in a winding position wherein the web cores are individually urged against the winding drum with a predetermined force, and for pivoting the web cores and the rewound material thereon from the winding position to an unloading position spaced apart from the winding drum. A cut-off means is also provided in each turret for cutting the web segments to allow each separate web core with the web material wound thereon to be removed from the slitter/rewinder apparatus. The slitter/rewinder further comprises a means associated with the cut-off means for affixing the end of least one of the web segments onto an associated web core means for rewinding the web material on the associated web core.

The winding roll support assembly of the slitter/rewinder apparatus may also include a support bar mounted on the turret parallel to the turret axis of rotation. At least one arm is mounted to the support bar for rotation to urge a web core and the rewound web material thereon against the winding drum. A chucking means is disposed at the second end of each arm for removably and rotatably mounting a web core. In this aspect of the invention, rotation of the support bar may index the winding roll from a winding position to an unloading position.

Another aspect of the invention provides an in-line process for winding a plurality of continuous, spaced web segments traveling at a predetermined web surface speed onto a plurality of cylindrical web cores. A winding drum means is driven at the predetermined web surface speed, and a set of spaced, axially aligned cylindrical web cores are moved from a loading position to a pre-splice position proximate the winding drum means, with the continuous web segments traveling between the web cores and the winding drum means. The web cores in each set are individually driven at the web surface speed. The web segments are severed proximate the set of web cores. An incoming end of a given severed web segment is attached to an associated one of the web cores to begin winding the web segments onto the associated web cores to form an active set of winding rolls. The active set of winding rolls is individually urged into contact with the winding drum means, and a predetermined force is maintained between each winding roll and the winding drum. Each of the web cores of the active winding rolls is driven at a predetermined torque. A previously completed set of winding rolls is unloaded from an unload position, and the active set of winding rolls is moved to the unload position without breaking contact between the winding rolls and the winding drum means. The steps of the process are repeated when the set of active winding rolls is completed in order to continuously produce rolls of material.

The in-line process may further include the step of longitudinally slitting a single web of material in order to form the plurality of continuous, spaced web segments. Alternating segments formed in the slitting step form first and second pluralities of continuous web segments, and the winding process may be performed on the second set of web segments using a second winding drum means and a second set of spaced, axially aligned web cores. The process may further include the step of automatically feeding the set of web cores into the core-loading position before moving the web cores to the pre-splice position. The pre-splice position of the web cores may be approximately one-half inch from the winding drum means. The steps of severing the web segments and urging the active set of winding rolls into contact with the winding drum means may occur substantially simultaneously.

The method and apparatus of the invention permit the slitting of a wide web into a plurality of web segments, and the rewinding of the web segments onto a plurality of associated web cores. The rewinding takes place with the use of a surface winding drum and separate winding arms applying a predetermined winding pressure for each of the winding rolls individually. The web cores may be changed without interrupting or slowing down the movement of the web into the apparatus, and therefore without interrupting the upstream process.

These and other objects, features and advantages of the present invention will be more readily apparent from the detailed description of the preferred embodiment set forth below, taken in conjunction with the accompanying drawings.

DETAILED DESCRIPTION OF THE PREFERRED EMBODIMENTS

Figure 1:
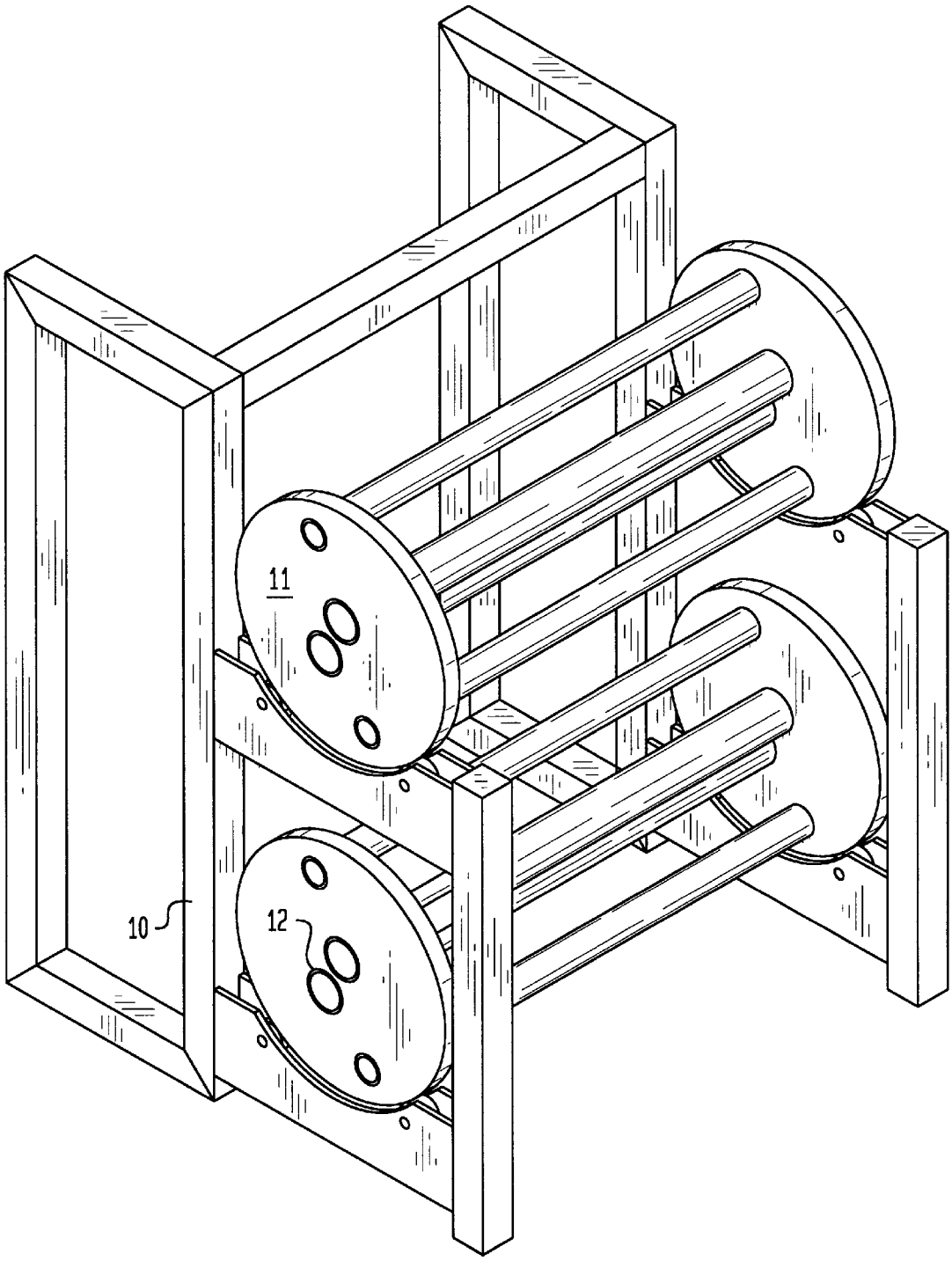
FIG. 1 is a schematic front left perspective view of a high speed winding apparatus according to the present invention.
Figure 2:
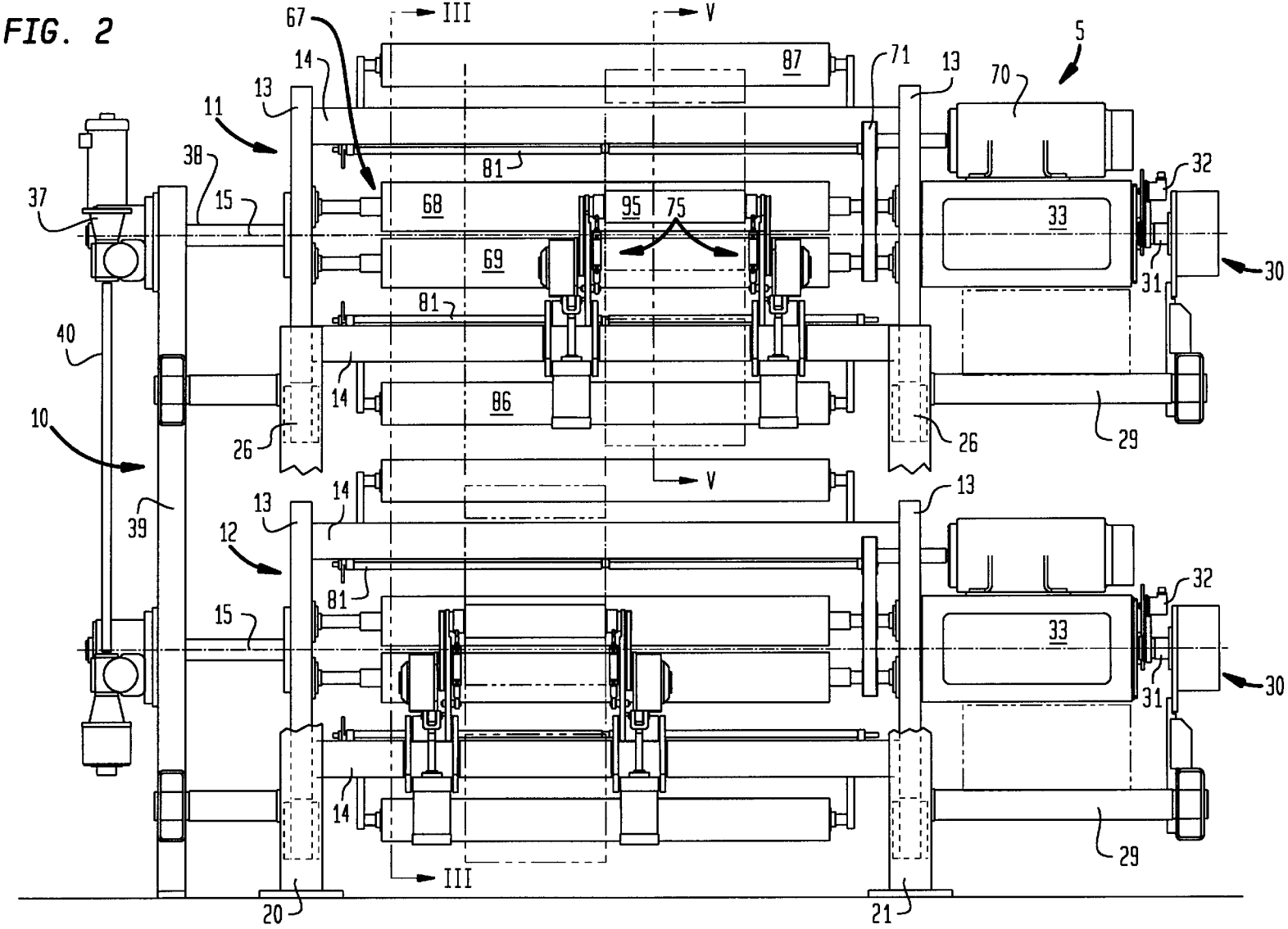
FIG. 2 is a front elevation view of the high speed winding apparatus according to the present invention.
Figure 4:
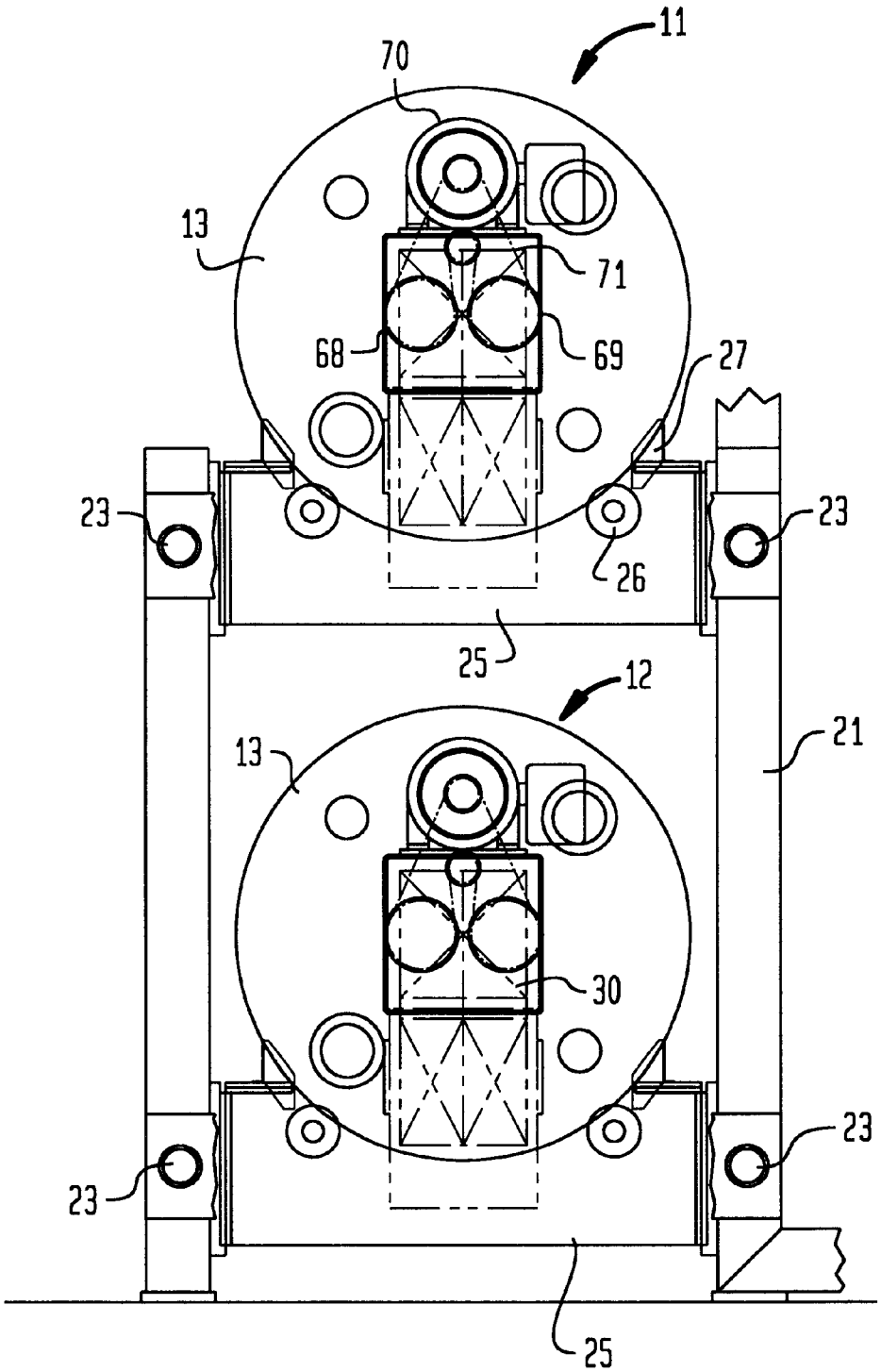
FIG. 4 is right side elevation view of the apparatus of FIG. 2.

A slitting/winding machine 5 according to the invention comprises a frame 10 in which are mounted two turrets 11, 12 (FIG. 1). The frame 10 comprises two main frame end weldments 20, 21 fabricated from rectangular steel tubing (FIGS. 2, 4). The main frame end weldments are interconnected by sized and spaced transverse pipe members 23 (FIG. 4) to form the rigid frame 10.

Each of the turrets 11, 12 comprises two turret end wheels 13 connected by two tubular winding arm supports 14 (FIG. 2). The winding arm supports are connected to the turret end wheels in diametrically opposite locations across the turret rotation axis 15, and are rigidly attached to the end wheels.

Two cradle assemblies 25 (FIG. 4) are incorporated into each of the end weldments 20, 21. Each of the turret assemblies 11, 12 is supported by a pair of the cradle assemblies 25, one in each main frame end weldment. Each cradle assembly 25 has rollers 26 with central grooves adapted to receive turret end wheels 13 in rolling contact. The turret end wheels 13 are maintained in rolling contact with the rollers 26 by gravity. This arrangement permits rotation of the turrets about a turret rotation axis through the center of the turret end wheels. The cradle assemblies 25 further comprise guards 27 that maintain the rolling surface of the turret end wheels relatively free from dirt and guard the pinch point created between the turret end wheels and the rollers 26.

Electrical power and control is provided to the rotating turrets through slip ring assemblies 30 (FIG. 2). Each slip ring assembly includes a stationary shaft 31 fixed to an auxiliary frame 29 extending from main frame end weldment 21. A series of slip rings (not shown) are mounted on the stationary shaft 31. A corresponding series of brushes (not shown) are mounted within a slip ring casing 33, which, in turn, is rigidly attached to one of the turret end wheels 13. The slip ring casing 33, together with the brushes mounted therein, rotates with the turret. The brushes maintain contact with the slip rings, transmitting electrical control signals and electrical power to the turret. A rotary encoder 32 may also be provided to sense the angular position of the turret.

Each turret is driven by a motor/worm gear assembly 37 mounted on an auxiliary frame 39 extending from the main frame end weldment 20. Each motor/worm gear assembly is connected to a respective turret end wheel 13 through a driveshaft 38 extending along the turret rotation axis 15. The two motor/worm gear assemblies 37 may be synchronized using a coupler shaft 40, and/or may be synchronized electronically, using rotary encoder sensors 32 for feedback information.

Figure 3:
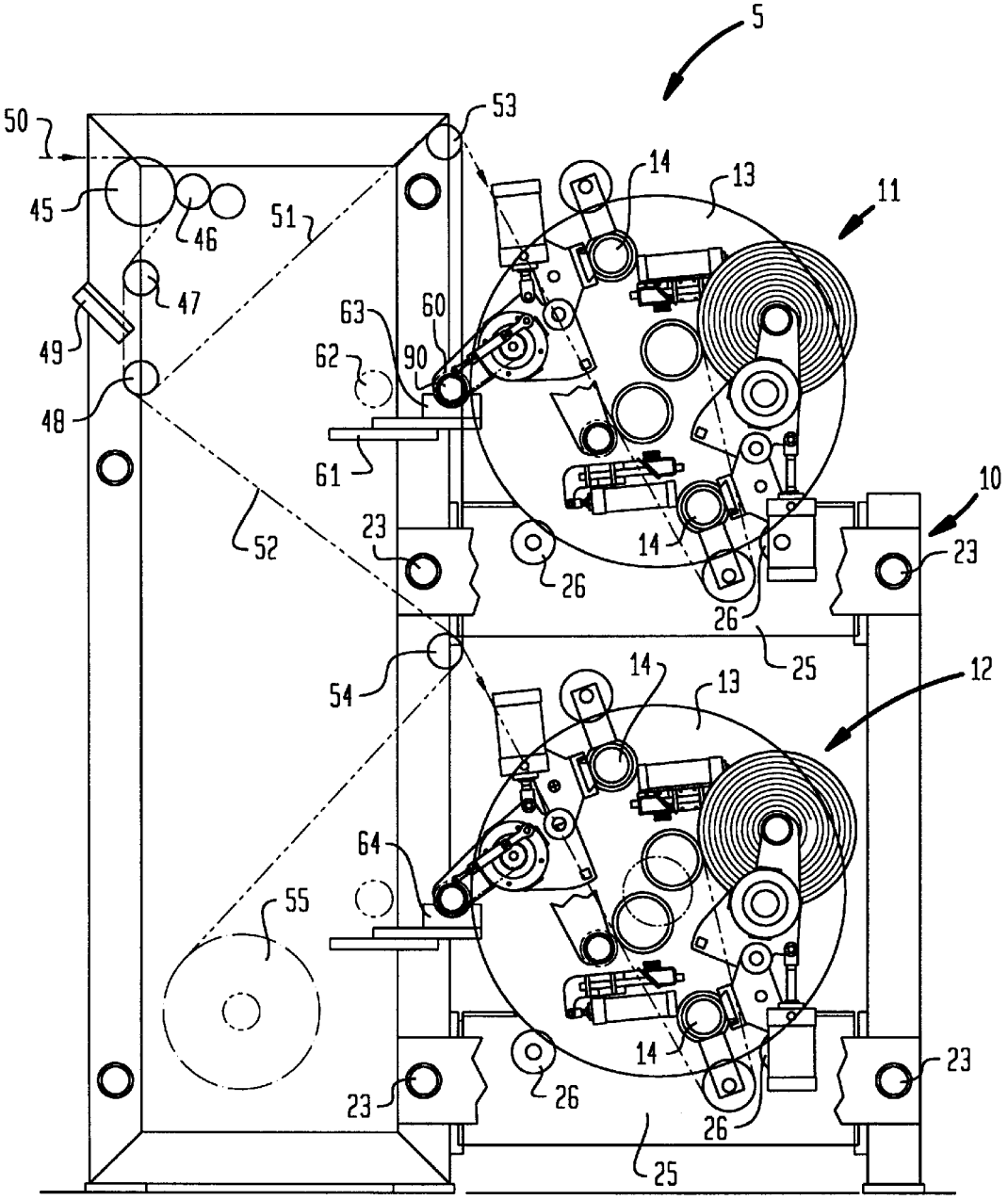
FIG. 3 is a fragmentary sectional view of the apparatus of FIG. 2 taken generally along line III—III.

The web 50 enters the slitting/rewinding machine 5 in the upper rear portion of the machine, as shown in FIG. 3. The web 50 may enter the machine directly from a processing line such as a web forming line or a printing line, or may be unrolled off-line from a master or jumbo roll that has been formed in a previous process. In either case, the web 50 passes through a nip formed by a driven roll 45 and an idler roll 46. The roll 45 is driven at the web surface speed, and the nip isolates any tension disturbances present in the web 50 before it enters the machine. After passing through the isolation nip, the web is slit between idler rolls 47 and 48 by one or more slitter knives 49, shown schematically in FIG. 3. For simplicity, the apparatus 5 described herein slits the web 50 at a single location to form two segments 51 and 52. Those skilled in the art will recognize that a plurality of knives 49 may be used to slit the web 50 into a plurality of segments, each to be wound on a separate core. The segments 51 and 52 are separated after passing around idler roll 48 and follow separate paths over idler rolls 53 and 54, before entering the turrets 11, 12, respectively. Where multiple slitting knives 49 slit the web into more than two separate segments, adjacent segments are routed to different turrets. Thus, a given turret receives segments that are spaced apart by the width of the intervening segment, which has been routed to the other turret. In a currently proposed embodiment, the web 50 is slit into six segments, with each turret receiving three non-adjacent segments.

A scrap roll 55 is provided in the lower part of the machine in order to receive scrap web segments produced during initial start-up and process changeover of the machine.

Empty cores 60 are introduced into the slitting/rewinding machine 5 through the rear of the machine. The core is generally of tubular paperboard construction, cut to a length corresponding to the web segment width. Other core constructions, such as plastic, may also be used. As shown in FIG. 3, the cores may be shuttled into a waiting position 62 by a conveyor belt (not shown) or other means running in a direction parallel to the turret rotation axis 15 (FIG. 2). A transfer mechanism 63, including an actuation means 61 (FIG. 3), transfers the empty cores 60 from the waiting position 62 to a loading position wherein a chuck 90 may automatically grasp the empty core, as described below. An additional transfer mechanism 64, together with an additional conveyor belt or other conveying means (not shown) is provided to feed the other turret.

Surface winding drum means 67, including a pair of surface winding drums 68, 69 (FIGS. 2, 5) is mounted near the turret rotation axis 15 of each turret 11, 12. The surface winding drums are located diametrically opposite each other, and are rotatably supported by bearings (not shown) in the end wheels 13 of the turrets. The surface winding drums 68, 69 are driven by a winding drum drive motor 70 through belt 71 (FIGS. 2, 4). The speed of the winding drum motor 70 is controlled to drive the surface winding drums at the same surface speed as the incoming web 50 (FIG. 3). The surface winding drums may be coated with an elastomeric or other high friction coating in order to better control the web as it is wound onto the winding rolls.

The winding drum drive motor 70 is mounted on the slip ring casing 33, and rotates with the turrets. Power is supplied to the motor 70 through the slip ring assembly within the casing 33.

Figure 5:
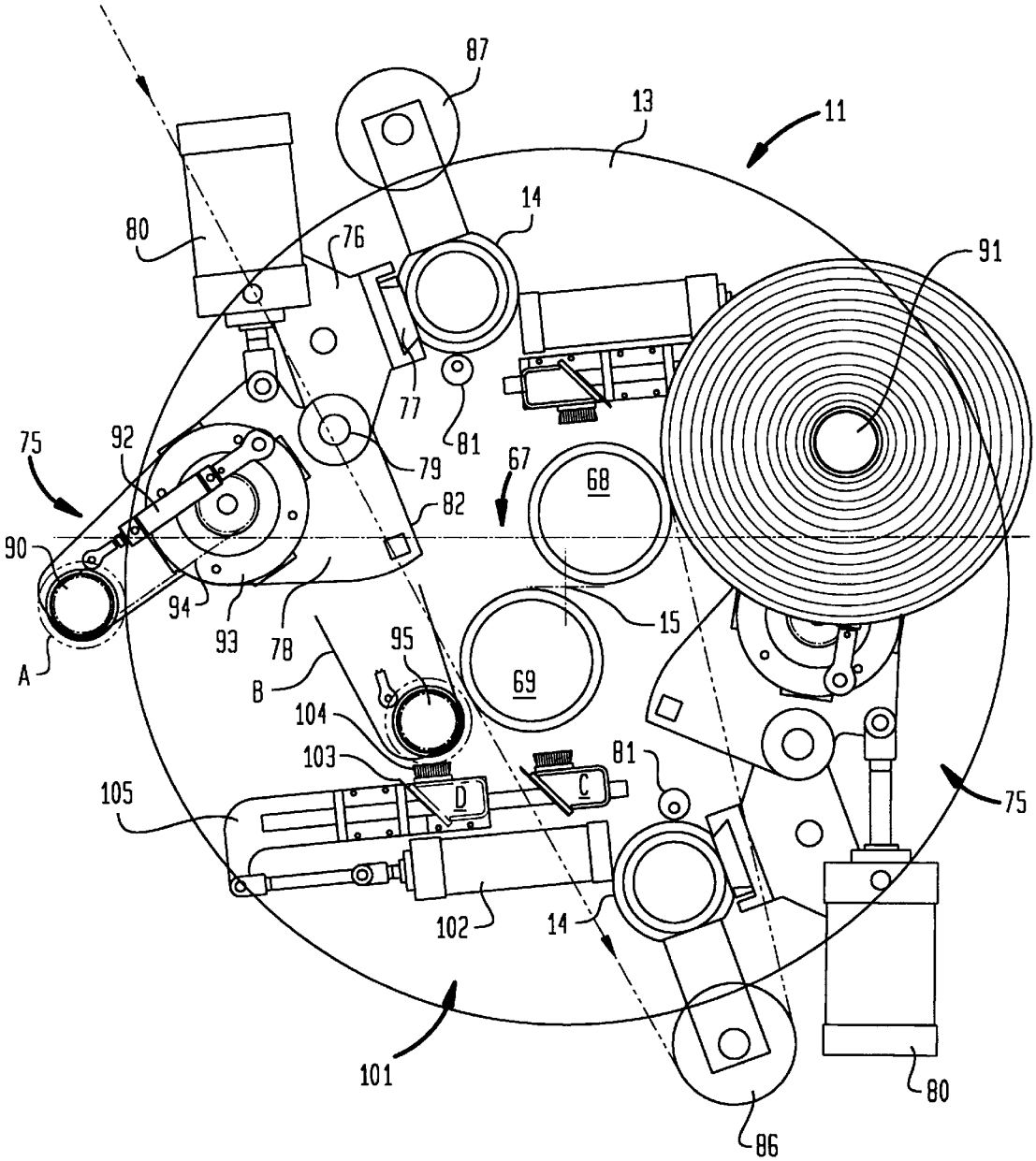
FIG. 5 is an enlarged cut away view of a turret of the apparatus of FIG. 2 taken generally along line V—V.

As best shown in FIG. 5, each winding arm support 14 supports one or more winding arm assemblies 75. A winding arm support 14, together with its winding arm assemblies 75, comprise a support assembly means. Each winding arm assembly 75 has, at its proximal end, a base 76 connected to the winding arm support 14 by a dovetail mount 77. The winding arm 78 is rotatably mounted to the winding arm base 76 using a dowel 79. The winding arm base 76 also supports a pneumatic cylinder 80 positioned for indexing the winding arm 78 about the dowel 79. The winding arm 78 is shown in FIG. 5 in a core loading position A, in which the cylinder 80 is retracted, and is shown in dotted lines in a winding position B in which the cylinder 80 is extended.

An eccentric cam mechanism 81 (FIGS. 2, 5) is positioned within the turret to contact surface 82 of the arm 78 and serve as a stop in order to provide a third, pre-splice position for the arm 78. The cam 81 stops the arm before the core 95 contacts the surface winding drum 69, in a position approximately one-half inch from the drum. The cam mechanism 81 may be rotated to a second position permitting the arm to extend to the winding position B in which the core 95 contacts the surface winding drum 69.

Figure 7:
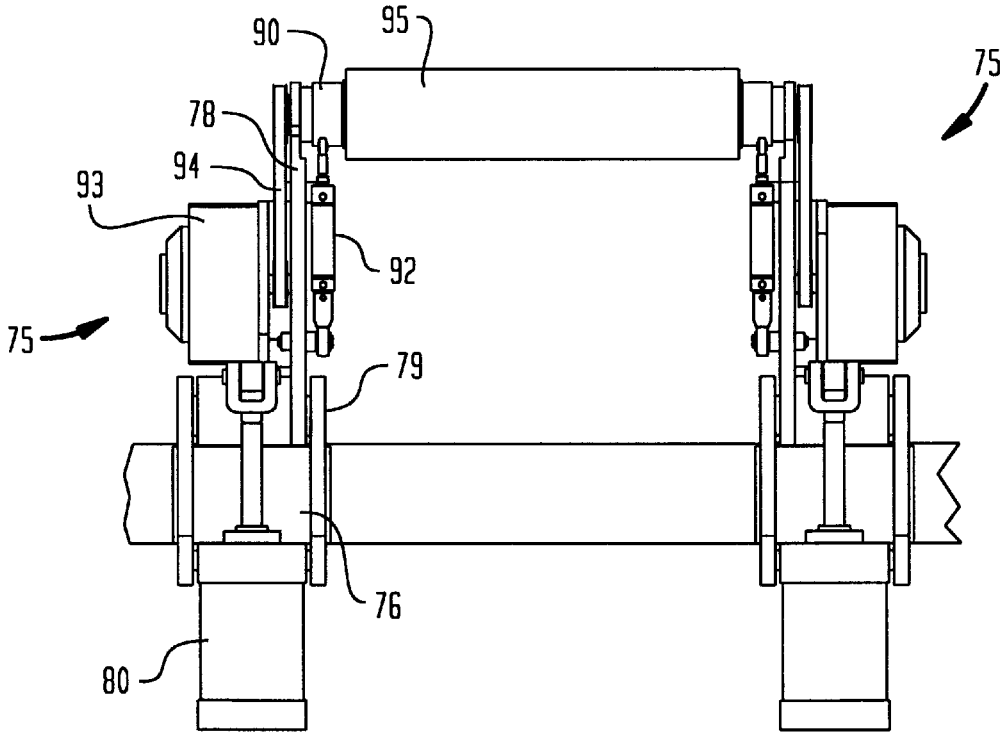
FIG. 7 is a fragmentary front elevation view of a pair of winding arms of the apparatus of FIG. 2.

Each winding arm 78 has a chuck 90 at its distal end. The chuck is actuated by a pneumatic cylinder 92, which rotates a helical cam (not shown) that moves the chuck 90 into the core 95 (FIG. 7). The chuck 90 may be completely retracted into the arm 78 to facilitate core loading and so that the arm, together with the chuck, may pass on either side of a web segment during rotation of the turret, as described below.

Each of the chucks 90 is rotationally driven by a pancake-type drive motor 93 through a belt 94. The motor 93 is mounted on the arm 78. The speed and torque output of the drive motor 93 may be controlled such that the surface speed of a new core on the driven chuck is equal to the web surface speed and to control torque on the winding roll.

The surface winding arm assemblies 75 may be disposed on the winding arm supports 14 in pairs, as shown in FIG. 7. In that case, each core 95 is supported by two chucks 90, one at each end of the core 95. The two winding arm assemblies 75 in a pair operate in unison, cooperating to index the core 95 between its various positions, and to rotate the core as required.

Alternatively, a single winding arm assembly may be used to suspend a core in a cantilever fashion. In that case, a longer, retractable chuck (not shown) may be used to grip the inside of core 95. A cantilever-type winding arm arrangement may be used to handle shorter cores corresponding to narrow web segments. The term "winding roll support arm means," as used herein, shall encompass both a single winding arm assembly and a pair of winding arms, as described.

Winding arm assemblies 75 may be arranged on the winding arm supports 14 to handle a wide variety of web slitting configurations. For example, as shown in FIG. 2, a single pair of winding arms may be installed on each winding arm support, for the processing of a web slit into two segments. In another embodiment, three pairs of winding arms are provided on each winding arm support, permitting the processing of a web slit into up to six segments. The dovetail mount 77 (FIG. 5)connecting the winding arm base 76 to the winding arm support 14 facilitates adjustment of the positions of the winding arm assemblies 75 on the winding arm support. A machine provided with three pairs of winding arms on each winding arm support 14 would therefore have great flexibility of use. Additionally, cantilever-style winding arms may also be provided on the same winding arm supports in order to provide the option of processing narrow web segments.

Turret idler rolls 86, 87 are mounted on brackets extending radially outward from the winding arm supports 14 (FIGS. 2, 5). The idler rolls extend the length of the turret (FIG. 2), and guide the web segment 51 in its path through the turret.

Two knife and brush assemblies 101 are mounted in each turret, one for each winding arm support. The knife and brush assembly 101 cuts the web segments 51 in a transverse direction, and urges the cut ends of the web segments against the empty cores 95 on the series of arm assemblies 75 mounted on the associated arm support.

Figure 6:
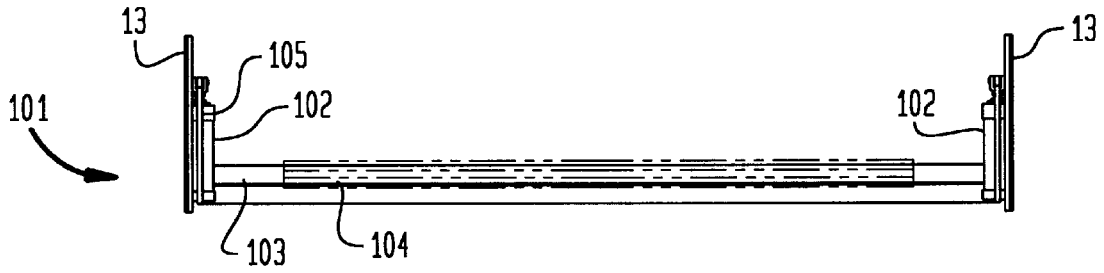
FIG. 6 is a fragmentary plan view of a knife/brush assembly for use in the apparatus of FIG. 2.

A knife and brush assembly 101 comprises two slides 105, slidably mounted on opposite turret end wheels 13 of a turret (FIGS. 5, 6). Pneumatic cylinders 102, also mounted to the turret end wheels 13, actuate the slides 105. A knife 103 and a brush 104 are mounted between the slides, and may be moved by the cylinders 102 from a ready position C to a fired position D (FIG. 5). Both the knife 103 and the brush 104 comprise continuous elements that extend across all web segments entering the turret (FIG. 6), so that no adjustment of the knife/brush assembly 101 is required when reconfiguring the machine by moving winding arm assemblies 75 on the winding arm supports 14.

The knife 103 has large serrations (not shown), for example, approximately one inch apart, to more effectively and quickly cut the web segment 51. In the fired position D, the bristles of brush 104 urge the cut web segment against the core 95 (FIG. 5).

A process according to the invention for continuously winding a plurality of spaced web segments will now be described with reference to FIGS. 8–11. A web segment 51 travels at a web surface speed over the idler roll 53 and into the turret 11. While the description of this process will be with reference to turret 11, a similar sequence occurs simultaneously in turret 12, where web segment 52 is processed.

Figure 8:
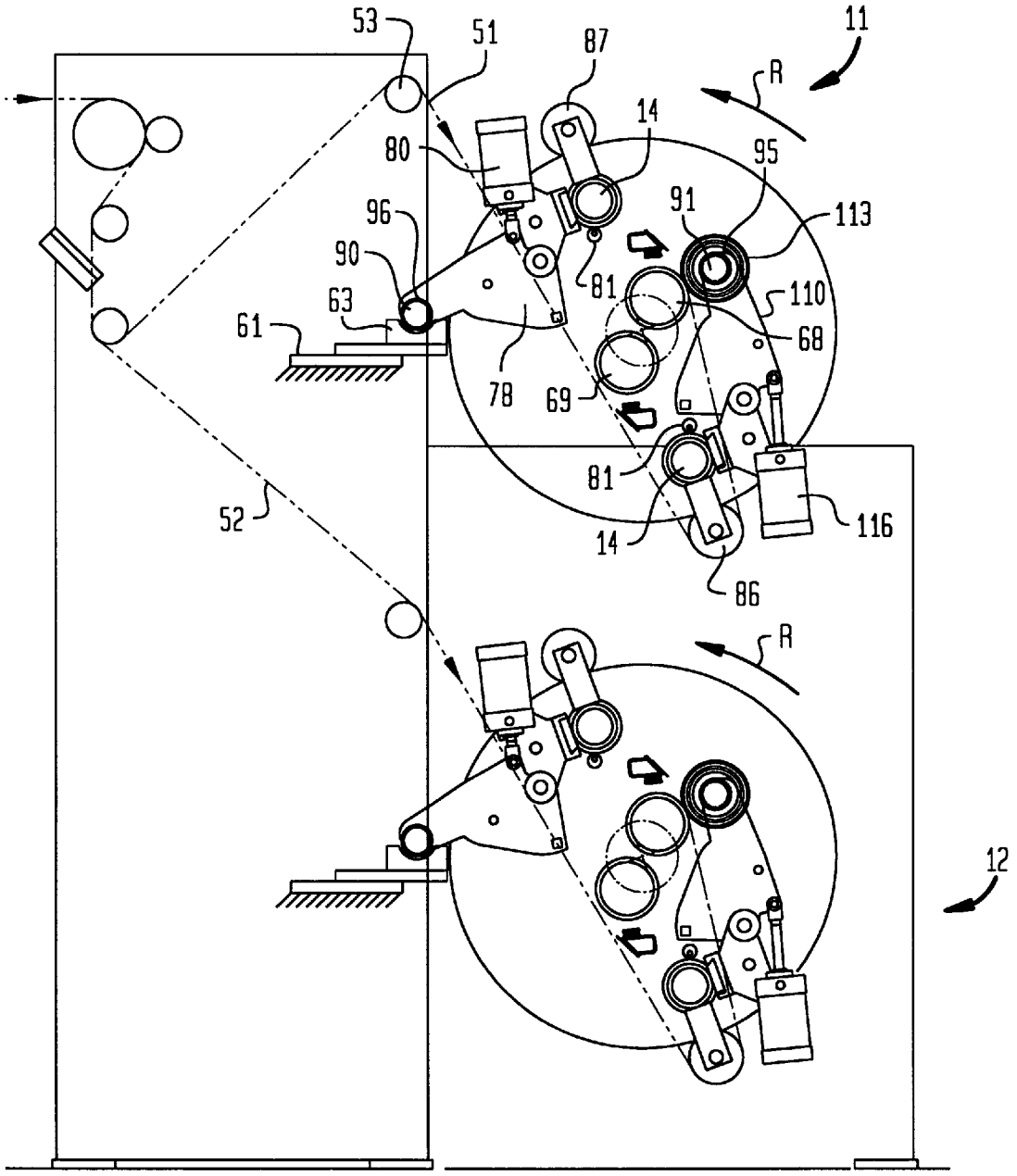
FIG. 8 is a fragmentary diagrammatic sectional view of a winding apparatus showing one step of a process according to the invention for continuously winding a plurality of spaced web segments.

The web segment 51 travels through the turret 11 and reverses direction as it passes over turret idler roll 86 on the opposing side of the turret (FIG. 8). The web 51 then enters the nip between the surface winding drum 68 and the winding roll 113 on winding arm 110, and is wound onto the winding roll 113. During winding of the roll 113, the surface winding drum 68 is driven at the constant surface speed of the web segment 51. The winding roll 113 is also driven by applying a predetermined torque through the chuck 95 in order to substantially eliminate torque transfer through the roll. The winding arm 110 is urged against the winding drum 68 by the pneumatic cylinder 116, so that the entire roll 113 is wound under a predetermined winding pressure between the winding roll 113 and the winding drum 68. The predetermined winding pressure may be varied from the inside to the outside layers of the roll, or may be constant throughout. The arm 110 swings outward, away from the winding drum 68, as the roll 113 increases in diameter.

As the winding roll 113 is wound on arm 110, an empty core 96 is loaded onto the arm 78. The arm 78 is maintained in a core loading position, as shown in FIG. 8, by the winding arm cylinder 80. The empty core 96, which has been brought into position on a conveyor or other means, is carried to the core loading position by the transfer mechanism 63. The empty core 96 is grasped by the chuck 90 on arm 78. If arm 78 is part of a pair of arms (FIG. 7), the two chucks 90 of the pair grasp either end of the core 96.

Core loading is performed in the rear of the machine, as shown in FIG. 8, so that, as the turret is indexed in the direction of arrow 'R', winding arms passing over the top of the turret are empty; i.e., carry no cores. Core loading in the rear of the machine thus permits the arms to pass around the sides of the web 51 during turret rotation. Because the web slitting and feeding operations also take place in the rear of the machine, it is desirable to use an automated mechanism such as the transfer mechanism 63 to load the cores onto the arms.

Figure 9:
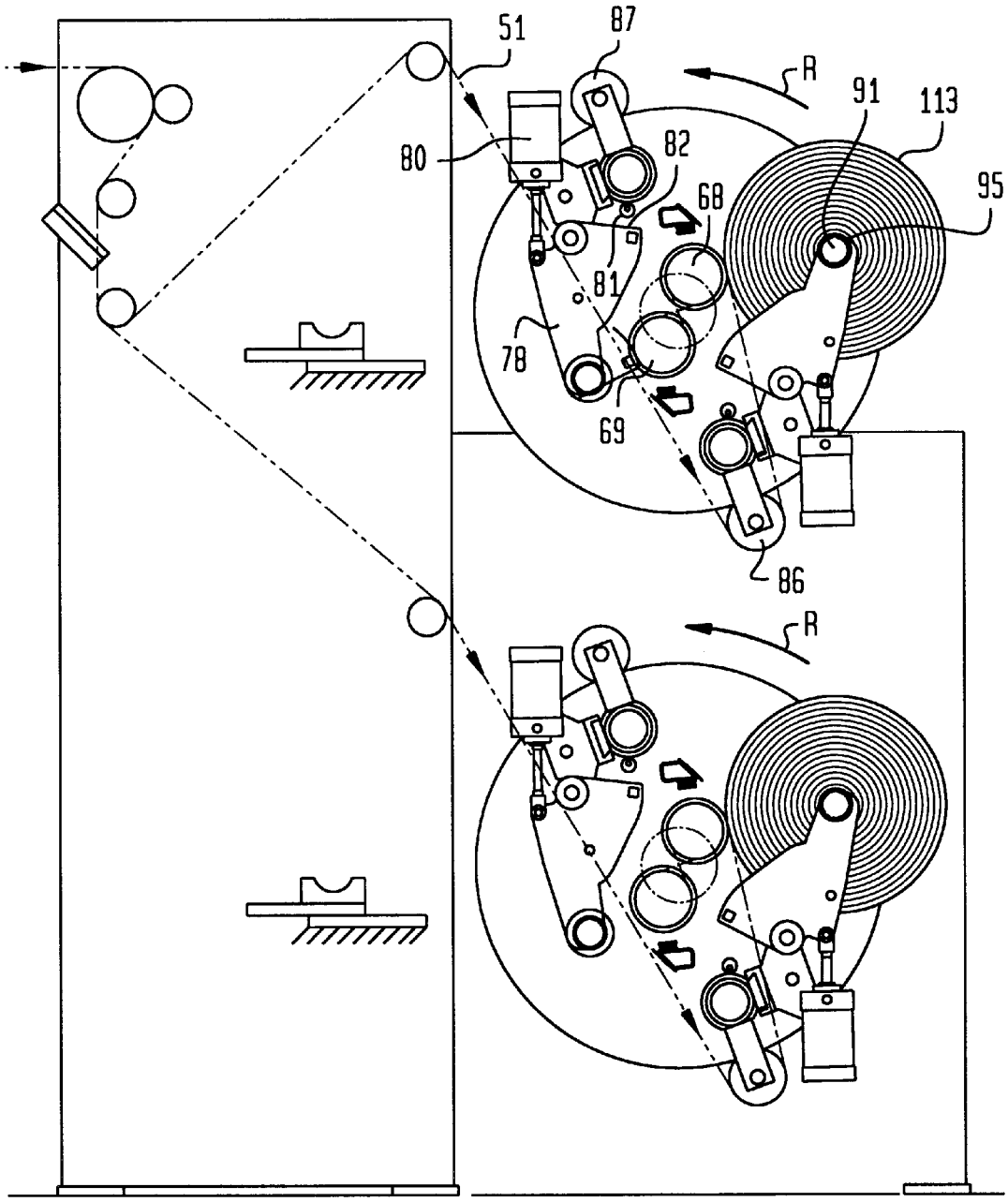
FIG. 9 is a fragmentary diagrammatic view of the apparatus of FIG. 8 showing a later step of the process.

After the empty core 96 has been loaded onto the arm 78, the core transfer mechanism 63 is retracted and the arm 78 is moved by arm cylinder 80 to a pre-splice position, wherein the core 96 is approximately one-half inch from the surface winding drum 69 (FIG. 9). The arm is maintained in the pre-splice position by urging the arm against the eccentric cam stop 81, which acts on the stop surface 82 of the arm 78. With the arm 78 in the pre-splice position, the web segment 51 passes between the core 96 and the surface winding drum 69.

The pre-splice position is maintained during the remainder of the winding cycle, during which the winding roll 113 reaches its final diameter, as shown in FIG. 9. During the winding cycle, the roll 113 is maintained in contact with the winding drum 68 at a predetermined winding pressure by the winding arm cylinder 116, and the core 95 is driven by the chuck 91 to substantially eliminate torque transfer through the roll 113.

Figure 10:
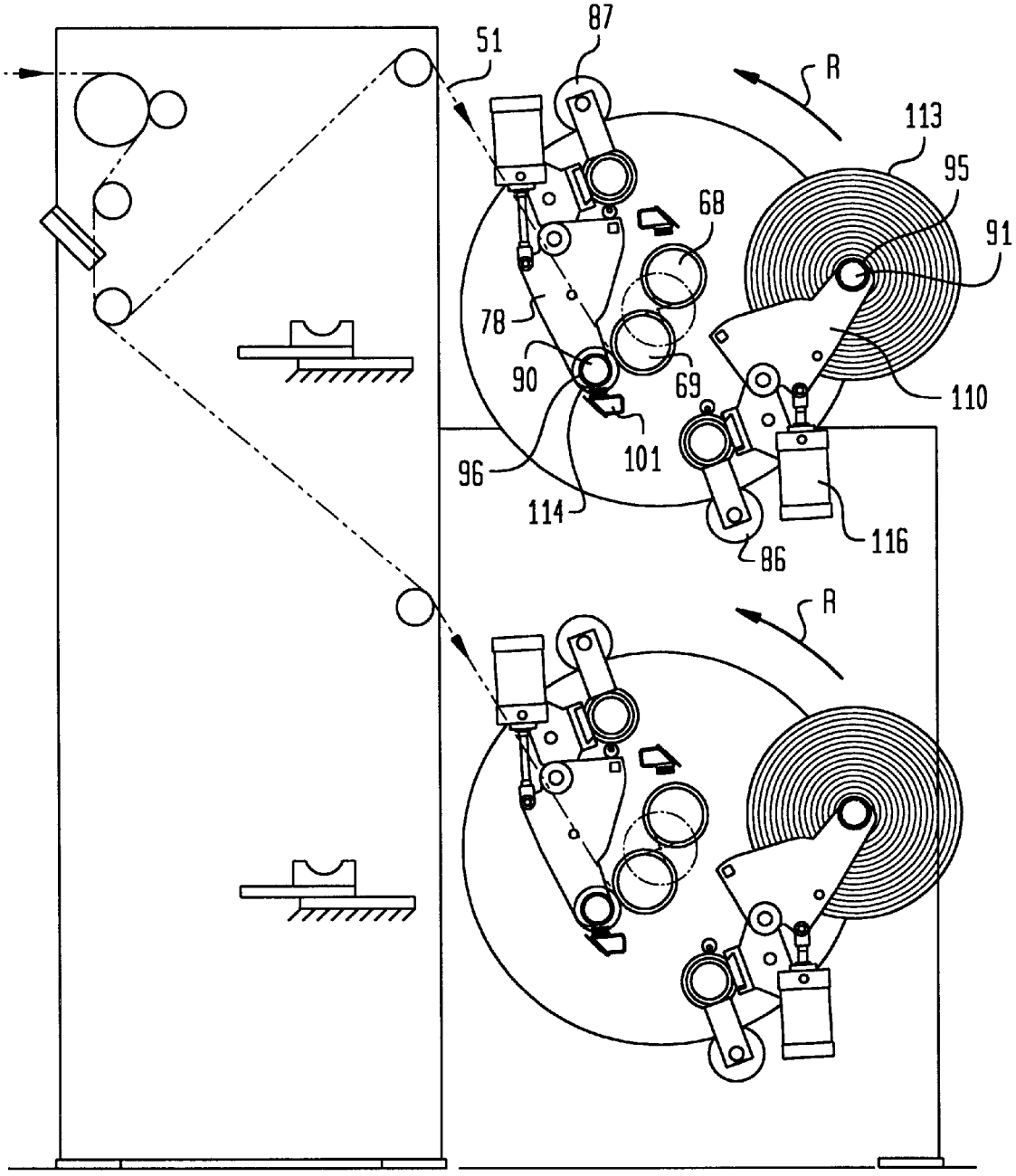
FIG. 10 is a fragmentary diagrammatic view of the apparatus of FIG. 8 showing a later step of the process.

In preparation for splicing, the empty core 96 on winding arm 78 is accelerated to rotate at the surface speed of the web segment 51. The web segment 51 is then spliced onto the empty core 96 (FIG. 10). During this step, the knife/brush assembly 101 is moved rapidly through the web, severing the web with the serrated knife 103. The brush 104 urges the severed web against the empty core 96, attaching the web to the core and initiating a winding cycle on that core. The empty core 96 may be precoated with an adhesive or tacky material before or during loading of the core onto the arm 78. The severed web segment thus adheres to the core 96, which is moving at the same surface speed as the web segment.

Simultaneously with the rapid traverse of the knife/brush assembly 101, the eccentric cam stop 81 is rotated, permitting the arm 78 to move to the winding position, with the newly forming winding roll 114 on the core 96 in contact with the surface winding drum 69. The winding arm cylinder 80 urges the winding roll 114 against the surface winding drum 69. Thus, during winding of the roll 114, surface speed is controlled by the winding drum 69, loosening of the roll 114 is minimized by driving the core 96, and winding pressure is controlled by the cylinder 80.

After the web is severed and spliced to the new core 96, the completed roll 113 is withdrawn from contact with the surface winding drum 68, brought to a stop, and indexed to an unload position, as shown in FIG. 10. The roll 113 is then unloaded from the arms at the front of the machine, in the position shown in FIG. 10. Unloading may be done manually, or may be done automatically.

Figure 11:
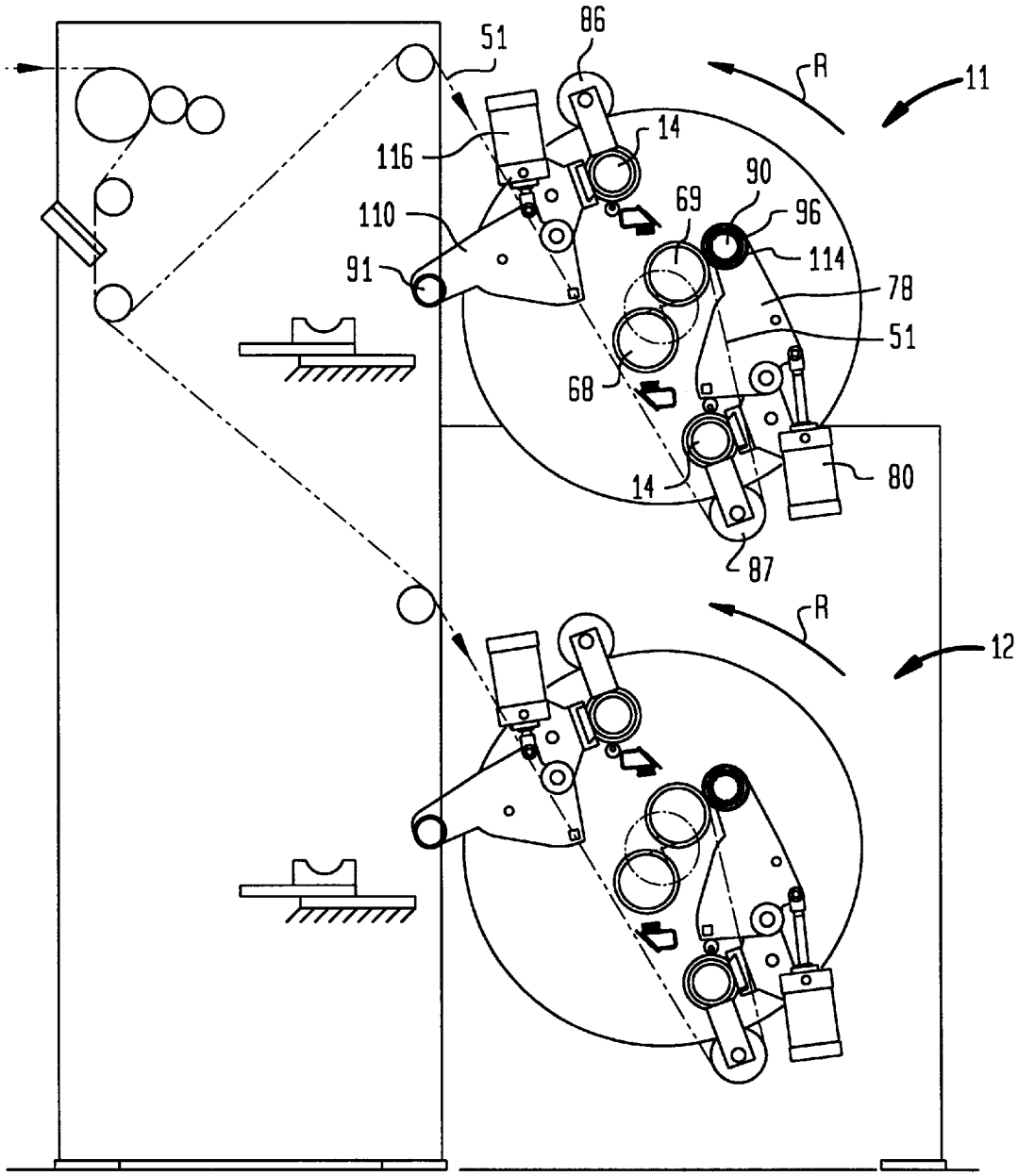
FIG. 11 is a fragmentary diagrammatic view of the apparatus of FIG. 8 showing a later step of the process.

Each of the turrets 11, 12 is next rotated 180° in the direction of arrow 'R' so that the positions of the winding arms 110, 78 are reversed, as shown in FIG. 11. During rotation of the turret 11, the turret idler roll 87 contacts the incoming web 51, maintaining the direction of entry of the web 51 into the nip formed between the winding roll 114 and the winding drum 69. After the half-revolution of turret 11 is complete, the web segment 51 passes through a point proximate winding drum 68, around the turret idler roll 87, and into the nip between the winding drum 69 and winding roll 114.

During the indexing of the turret 11, the winding arm 110, including the chuck 91, passes from one side of the web segment 51 to the other. This is possible because the chuck 91 is retracted into the arm 110, thereby clearing the web segment 51. Furthermore, the roll 113, which would otherwise interfere with rotation of the turret by colliding with the web 51, is removed in the front of the machine and before rotation of the turret.

The described arrangement permits the automated changing of roll cores without interrupting the web infeed, and without compromising the quality and uniformity of the wound rolls. As the turret is rotated, the winding roll 114 never breaks contact with the surface winding drum 69 so the roll is surface-wound to the outermost layer. Furthermore, throughout the entire turret rotation, winding pressure is maintained constant by air cylinder 80, and torque transferred through the winding roll is controlled by driving the chucks 90. The quality of the layers of roll 114 wound during rotation of the turret 11 is therefore consistent with the quality of the remaining roll.

As will be appreciated, numerous variations and combinations of the features discussed above can be utilized. For example, the surface winding drum means 67 may comprise a single winding drum instead of the two winding drums 68, 69 disclosed above. The winding arm supports 14 may be mounted in bearings in the turret end wheels 13 for rotation within the turret. In that case, rotation of the winding arm support bars 14 is used for most movement of the winding arms, and individual winding arm motion is used only to compensate for individual roll sizes. As these and numerous other variations and combinations of the features discussed above may be employed without departing from the present invention, the foregoing description of the preferred embodiment should be taken by way of illustration, rather than by way of limitation of the features discussed above.

What is claimed is:

1. A high speed winding apparatus for the continuous rewinding of various independent widths of web material onto sized web cores, and for automatically changing wound web cores with empty web cores without interrupting said continuous rewinding, comprising:

(a) a frame;

(b) a turret means rotatably mounted in said frame for rotation about a turret means axis;

(c) winding drum means including a first winding drum and a second winding drum rotatably mounted in said turret means in generally opposing locations offset from said turret means axis;

(d) first and second winding roll support arm means having, proximal ends pivotally mounted on said turret means in opposing locations offset from said turret means axis outboard of said winding drum means, and distal ends for supporting respective first and second sized web cores for rewinding said independent widths of web material thereon; and (e) said support arm means being indexable between a winding position wherein said sized web cores receiving the independent widths of said web material are disposed to bring the respective widths of said web material into generally continuous rolling contact with an associated one of said winding drum means for surface winding of said independent widths of said web material to provide uniformly wound web material on each of the respective wound web cores and an unloading/loading position wherein wound web cores are remote from said winding drum means when the turret means is rotated for initially repositioning an empty web core on at least one of the respective first and second support arm means for the continuous winding of additional independent widths of the web material.

2. A high speed winding apparatus as claimed in claim 1, wherein said respective winding roll support arm means includes, core chucking means on said distal ends of the respective support arms, and said chucking means being retractable such that said support arms of one of the opposing winding roll support arm means clears the web material being wound on the sized web cores of the opposing winding roll support arm means during rotation of said turret means.

3. A high-speed winding apparatus as claimed in claim 1, wherein said respective winding roll support arm means includes, driving means for the respective web cores for driving said web cores at the surface speed of the web material being wound thereon to maintain generally uniform winding of the web material on said web cores.

4. A high-speed winding apparatus as claimed in claim 1, wherein at least one of said winding roll support arm means includes, first and second arms for chucking a sized web core therein.

5. A high-speed winding apparatus as claimed in claim 1, wherein at least one of said winding roll support arm means includes, a single arm for chucking an associated sized web core therein.

6. A high-speed winding apparatus as claimed in claim 1, further comprising first and second cut-off means mounted on said turret means in proximity with corresponding first and second support arm means, for cutting said web during the automatic changing of web cores.

7. A high-speed winding apparatus as claimed in claim 6, wherein each said cut-off means comprises:

(a) a knife for cutting the web;

(b) a brush for urging the cut web against an empty core in said winding position for initiating winding of a new winding roll; and (c) an actuation means for moving said knife through said web and moving said brush past said empty core.

8. A high-speed winding apparatus as claimed in claim 1, wherein said first and second winding roll support arm means are further indexable to a pre-splice position wherein said empty core is proximate to but not in contact with said winding drum.

9. A high-speed winding apparatus as claimed in claim 8, further comprising a moveable stop mounted to said turret for positioning said winding roll support arm means in said pre-splice position.

10. A high speed slitter/rewinder apparatus for slitting a web of material into a plurality of predetermined widths and for the continuous rewinding of the plurality of widths onto a plurality of sized web cores and for automatically changing wound web cores with empty web cores without interrupting the continuous rewinding, comprising:

(a) a frame;

(b) slitter means associated with said apparatus and frame for longitudinally slitting the web material into the plurality of predetermined widths;

(c) turret means rotatably mounted in said frame for rotation about a turret means axis;

(d) winding drum means including a first winding drum and a second winding drum rotatably mounted in said turret means in generally opposing locations offset from said turret means axis;

(e) first and second winding roll support arm means having, proximal ends pivotally mounted in said turret means in opposing locations offset from said turret means axis outboard of said winding drum means, and distal ends for supporting respective first and second sized web cores for rewinding respective predetermined widths of said web material on associated web cores;

(f) said support arm means being indexable between a winding position wherein said sized web cores receiving the associated predetermined widths of said web material are disposed to bring the web material into generally continuous rolling contact with an associated one of said winding drum means for surface winding of said predetermined widths of web material on an associated web core and an unloading/loading position wherein wound web cores are remote from said winding drum means when the turret means is rotated for initially repositioning an empty web core on at least one of the respective first and second support arm means for the continuous rewinding of a predetermined width of said web material;

(g) means operatively associated with said first and second support arm means for exerting a predetermined force on the associated rewinding web cores with the widths of web material being wound thereon during rolling engagement with an associated winding drum means for generally uniform rewinding of said widths of web material on said web cores; and (h) said first and second support arms means including, chucking means for holding sized web cores therein, and independent driving and control means for driving the chucking means at a speed approximately equal to the surface speed of the web material wound on the web core held by the chuck to substantially eliminate torque transfer through the web core whereby the coaction between the surface winding by the winding drum means and the speed of the web core enables the winding pressure to be varied from the inside to the outside layers of the predetermined widths of web material being wound on a given one of the said web cores.

11. A high speed slitter/rewinder apparatus as in claim 10 further comprises a means for moving the predetermined widths of web material being wound on the web cores into rolling engagement. with a winding roll means further comprising actuable support bar means connected at one end in said turret means and at the opposite end to the distal end of an associated one of said first and second support arm means whereby on actuation of the support bar means the distal end of the associated one of the first and second support arms means is pivoted to bring the web core with the predetermined width of web material thereon into rolling engagement with the winding drum means.

12. A high speed slitter/rewinder apparatus as in claim 11 wherein said support bar is further actuable to index the distal end of the respective associated end of one of the first and second support arms to move the wound web core thereon from said winding position to the unloading/loading position.

13. A high-speed slitter/rewinding apparatus as in claim 10, further comprising, first and second cut-off means mounted in said turret means in proximity with the corresponding first and second support arm means, for cutting predetermined diameters of said web material after one of the web cores has been wound.

14. A high-speed slitter/rewinding apparatus as in claim 13, wherein each of said first and second cut-off means comprises:

(a) a knife for cutting the web;

(b) a brush for urging the cut web against an empty web core in position for initiating winding of the web core; and (c) an actuation means for simultaneously moving said knife through said predetermined width of the web material and moving said brush to trap the cut section of the web material and bring it into position for affixation on the empty web core.

* * * * *